US005358843A

United States Patent [19]

Sakizadeh et al.

[11] Patent Number: 5,358,843

[45] Date of Patent: Oct. 25, 1994

[54] PHOTOTHERMOGRAPHIC ELEMENTS CONTAINING SILYL BLOCKING GROUPS

[75] Inventors: Kumars Sakizadeh, Woodbury; Sharon M. Simpson, Lake Elmo; Omar Farooq, Woodbury; Sam Kalousdian, Maplewood, all of Minn.

[73] Assignee: Minnesota Mining and Manufacturing Company, St. Paul, Minn.

[21] Appl. No.: 109,637

[22] Filed: Aug. 20, 1993

[51] Int. Cl.[5] ..... G03C 1/498

[52] U.S. Cl. ..... 430/619; 430/607; 430/613; 430/614; 430/615; 430/617

[58] Field of Search ..... 430/619, 613, 607, 614, 430/615, 959, 960, 617

[56] References Cited

U.S. PATENT DOCUMENTS

| | | | |
|---|---|---|---|
| 3,180,731 | 4/1965 | Roman et al. | 96/29 |
| 3,457,075 | 7/1969 | Morgan et al. | 96/57 |
| 3,531,286 | 9/1970 | Renfrew | 96/67 |
| 3,615,617 | 10/1971 | Muller-Bardorff et al. | 96/109 |
| 3,674,478 | 7/1972 | Grasshoff et al. | 96/3 |
| 3,698,898 | 10/1972 | Grasshoff et al. | 96/3 |
| 3,700,457 | 10/1972 | Youngquist | 96/114.1 |
| 3,761,270 | 9/1973 | deMauriac et al. | 96/77 |
| 3,791,830 | 2/1974 | Abele | 96/76 R |
| 3,839,049 | 10/1974 | Simons | 96/114.6 |
| 3,844,797 | 10/1974 | Willems et al. | 96/114.1 |
| 3,846,136 | 11/1974 | Sullivan | 96/114.1 |
| 3,993,661 | 11/1976 | Grasshoff et al. | 260/308 D |
| 3,994,732 | 11/1976 | Winslow | 96/114.1 |
| 4,009,029 | 2/1977 | Hammond et al. | 96/3 |
| 4,021,240 | 5/1977 | Cerquone et al. | 96/29 D |
| 4,021,249 | 5/1977 | Noguchi et al. | 96/114.1 |
| 4,022,617 | 5/1977 | McGuckin | 96/29 D |
| 4,128,557 | 12/1978 | Knight et al. | 260/299 |
| 4,137,079 | 1/1979 | Houle | 98/55 |
| 4,138,265 | 2/1979 | Shiao | 96/114.1 |
| 4,144,072 | 3/1979 | Ikenoue et al. | 96/114.1 |
| 4,187,108 | 2/1980 | Willis | 430/203 |
| 4,245,033 | 1/1981 | Eida et al. | 430/353 |
| 4,260,677 | 4/1981 | Winslow et al. | 430/618 |
| 4,283,488 | 8/1981 | VanLare | 430/585 |
| 4,310,612 | 1/1982 | Mooberry et al. | 430/223 |
| 4,335,200 | 6/1982 | Ohashi et al. | 430/446 |
| 4,350,752 | 9/1982 | Reczek et al. | 430/219 |
| 4,351,896 | 9/1982 | Altland et al. | 430/354 |
| 4,374,921 | 2/1983 | Frenchik | 430/338 |
| 4,378,424 | 3/1983 | Altland et al. | 430/352 |
| 4,404,390 | 9/1983 | Altland et al. | 548/263 |
| 4,416,977 | 11/1983 | Ohashi et al. | 430/446 |
| 4,420,554 | 12/1983 | Ohashi et al. | 430/446 |
| 4,426,441 | 1/1984 | Adin et al. | 430/351 |
| 4,451,561 | 5/1984 | Hirabayashi et al. | 430/619 |
| 4,460,681 | 7/1984 | Frenchik | 430/502 |
| 4,510,236 | 4/1985 | Gutman | 430/619 |
| 4,511,644 | 4/1985 | Okamura et al. | 430/219 |
| 4,678,735 | 7/1987 | Kitaguchi et al. | 430/203 |
| 4,837,141 | 6/1989 | Kohno et al. | 430/559 |
| 4,883,747 | 11/1989 | Grieve et al. | 430/542 |

OTHER PUBLICATIONS

Research Disclosure 16977 (May 1978).
Research Disclosure 16979 (May 1978).
Research Disclosure 17029 (Jun. 1978).
Research Disclosure 29963 (Mar. 1989).

*Primary Examiner*—Thorl Chea
*Attorney, Agent, or Firm*—Gary L. Griswold; Walter N. Kirn; Gregory A. Evearitt

[57] ABSTRACT

Photothermographic elements containing image-forming emulsions with photothermographically useful compounds (e.g., stabilizers, toners, activators, developers, etc.) which are blocked with silyl groups, but become deblocked in the presence of a source of fluoride ion.

20 Claims, No Drawings

PHOTOTHERMOGRAPHIC ELEMENTS CONTAINING SILYL BLOCKING GROUPS

BACKGROUND OF THE INVENTION

1. Field of Invention

This invention relates to novel, heat-developable photothermographic elements and in particular, it relates to photothermographic elements containing photographically useful materials with silyl blocking groups.

2. Background to the Art

Silver halide-containing, photothermographic imaging materials (i.e., heat-developable photographic materials) processed with heat, and without liquid development, have been known in the art for many years. These materials, also known as "dry silver" compositions or emulsions, generally comprise a support having coated thereon: (1) a photosensitive material that generates atomic silver when irradiated, (2) a non-photosensitive, reducible silver source, and (3) a reducing agent for the non-photosensitive, reducible silver source, and (4) a binder. The photosensitive material is generally photographic silver halide which must be in catalytic proximity to the non-photosensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source. It has long been understood that elemental silver ($Ag^{\circ}$) is a catalyst for the reduction of silver ions, and a progenitor of the photosensitive photographic silver halide may be placed into catalytic proximity with the non-photosensitive, reducible silver source in a number of different fashions, such as by partial metathesis of the reducible silver source with a halogen-containing source (see, for example, U.S. Pat. No. 3,457,075), coprecipitation of silver halide and reducible silver source material (see, for example, U.S. Pat. No. 3,839,049), and other methods that intimately associate the photosensitive photographic silver halide and the non-photosensitive, reducible silver source.

The non-photosensitive, reducible silver source is a material that contains silver ions. The preferred non-photosensitive reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates, have been proposed, and U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image generally is not visible by ordinary means and the photosensitive emulsion must be further processed in order to produce a visible image. The visible image is produced by the reduction of silver ions, which are in catalytic proximity to silver halide grains bearing the clusters of silver atoms, i.e. the latent image. This produces a black and white image.

As the visible image is produced entirely by elemental silver ($Ag^{\circ}$), one cannot readily decrease the amount of silver in the emulsion without reducing the maximum image density. However, reduction of the amount of silver is often desirable in order to reduce the cost of raw materials used in the emulsion.

A variety of ingredients may be added to these basic components to enhance performance. For example, toning agents may be incorporated to improve the color of the silver image of the photothermographic emulsions, as described in U.S. Pat. Nos. 3,846,136; 3,994,732; and 4,021,249.

One conventional way of attempting to increase the maximum image density of photographic and photothermographic emulsions without increasing the amount of silver in the emulsion layer is by incorporating dye-forming materials in the emulsion. Color images can be formed by incorporation of leuco dyes into the emulsion. Leuco dyes are the reduced form of a color-bearing dye. Upon imaging, the leuco dye is oxidized, and the color-bearing dye and a reduced silver image are simultaneously formed in the exposed region. In this way, a dye enhanced silver image can be produced, as shown, for example, in U.S. Pat. Nos. 3,531,286; 4,187,108; 4,426,441; 4,374,921; and 4,460,681.

Multicolor photothermographic imaging elements typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic elements having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747; and *Research Disclosure,* March 1989, item 29963.

One common problem that exists with photothermographic systems is the instability of the image following processing. The photoactive silver halide still present in the developed image may continue to catalyze print-out of metallic silver during room light handling. Thus, there exists a need for stabilization of the unreacted silver halide. The addition of separate postprocessing image stabilizers or stabilizer precursors provides the desired post-processing stability. Most often these are sulfur-containing compounds such as mercaptans, thiones, and thioethers as described in Research Disclosure 17029. U.S. Pat. No. 4,245,033 describes sulfur compounds of the mercapto-type that are development restrainers of photothermographic system. See also U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles, such as 3-amino-5-benzothio-1,2,4-triazole, used as post-processing stabilizers are described in U.S. Pat. Nos. 4,128,557; 4,137,079; 4,138,265; and *Research Disclosure* 16977 and 16979.

Some of the problems with these stabilizers include thermal fogging during processing or losses in photographic sensitivity, maximum density, or contrast at effective stabilizer concentrations.

Stabilizer precursors have blocking or modifying groups that are usually cleaved during processing with heat and/or alkali. This provides the primary active stabilizer which can combine with the photoactive silver halide in the unexposed and undeveloped areas of the photographic material. For example, in the presence of a silver halide precursor in which the sulfur atom is blocked upon processing, the resulting silver mercaptide will be more stable than the silver halide to light, atmospheric, and ambient conditions.

Various blocking techniques have been utilized in developing the stabilizer precursors. U.S. Pat. No. 3,615,617 describes acyl blocked photographically useful stabilizers. U.S. Pat. Nos. 3,674,478 and 3,993,661 describe hydroxyarylmethyl blocking groups. Benzylthio releasing groups are described in U.S. Pat. No. 3,698,898. Thiocarbonate blocking groups are described in U.S. Pat. No. 3,791,830, and thioether blocking groups in U.S. Pat. Nos. 4,335,200, 4,416,977, and 4,420,554. Photographically useful stabilizers which are blocked as urea or thiourea derivatives are described in U.S. Pat. No. 4,310,612. Blocked imidomethyl derivatives are described in U.S. Pat. No. 4,350,752, and imide or thioimide derivatives are described in U.S. Pat. No. 4,888,268. Removal of all of these aforementioned blocking groups from the photographically useful stabilizers is accomplished by an increase of pH during alkaline processing conditions of the exposed imaging material.

Other blocking groups which are thermally sensitive have also been utilized. These blocking groups are removed by heating the imaging material during processing. Photographically useful stabilizers blocked with thermally sensitive carbamate derivatives are described in U.S. Pat. Nos. 3,844,797 and 4,144,072. These carbamate derivatives presumably regenerate the photographic stabilizer through loss of an isocyanate. Hydroxymethyl blocked photographic reagents which are unblocked through loss of formaldehyde during heating are described in U.S. Pat. No. 4,510,236. Development inhibitor releasing couplers releasing tetrazoylthio moieties are described in U.S. Pat. No. 3,700,457. Substituted benzylthio releasing groups are described in U.S. Pat. No. 4,678,735; and U.S. Pat. Nos. 4,351,896 and 4,404,390 utilize carboxybenzylthio blocking groups for mesoionic 1,2,4-triazolium-3-thiolates stabilizers. Photographic stabilizers which are blocked by a Michael-type addition to the carbon-carbon double bond of either acrylonitrile or alkyl acrylates are described in U.S. Pat. Nos. 4,009,029 and 4,511,644, respectively. Heating of these blocked derivatives causes unblocking by a retro-Michael reaction.

Various disadvantages attend these different blocking techniques. Highly basic solutions which are necessary to cause deblocking of the alkali sensitive blocked derivatives are corrosive and irritating to the skin. With the photographic stabilizers which are blocked with a heat removable group, it is often found that the liberated reagent of by-product, for example, acrylonitrile, can react with other components of the imaging construction and cause adverse effects. Also, inadequate or premature release of the stabilizing moiety within the desired time during processing may occur.

Thus, there has been a continued need for improved post-processing stabilizers that do not fog or desensitize the photographic materials, and stabilizer precursors that release the stabilizing moiety at the appropriate time and do no have any detrimental effects on the photosensitive material or user of the material.

Silyl groups have long been employed to derivatize and protect various substrates during chemical and synthetic sequences. The silyl protection of a hydroxy group is simply a replacement of the active hydrogen by the silyl group. See, for example, L. Berkofer and A. Ritter, "*Newer Methods in Preparative Organic Chemistry*," Vol. V, Academic Press, New York, NY, 1968, page 221; A. E. Pierce, "*Silylation in Organic Compounds*," Pierce Chemical Co., Rockford, Ill., 1968; and J. F. Klebe, *Acc. Chem Res.*, 1979, 3, 299. The technique affords products which are more chemically stable and will undergo subsequent chemical reactions at sites other than the silyl-blocked one.

Simple deblocking of a trialkylsilyl group is well-known in the art. See McOmie, J. F. W. Ed., "*Protective Groups in Organic Chemistry*," 1975; and Pierce, A. E., "*Silylation of Organic Compounds*," Pierce Chemical Co., Rockford, Ill., 1968. It is usually effected in aqueous or aqueous methanol media at ambient temperature, reflux, or using acid-catalysis. See C. C. Sweeley, R. Bentley, M. Makita, and W. W. Wells, *J. Amer. Chem. Soc.* 1963, 85, 2497; A. G. Sharkey, Jr.; R. A. Friedel, and S. H. Langer, *Analyt. Chem.* 1957, 29, 770. Deblocking under such conditions is usually facile. Such procedures have limitations for those materials which involve siloxane materials in that the latter during storage suffer instability prior to their use.

Fluorinative de-silylation is also known in the art (see, for example, S. J. Brown and J. H. Clark, *J. Fluorine Chemistry* 1985, 30, 251 and G. G. Yakobson and N. E. *Akmentova, Synthesis* 1983, 169; M. Gerstenberger and A. Haas *Angew. Chem., Int'l Ed. Engl.* 1981 20, 647). The procedure generally uses alkali metal salts under ambient conditions or heating depending on the nature of the precursor materials. When used in the de-silylation of siloxylated materials the latter exhibit de-blocking within short period of time. A major factor contributing to the wide acceptance of silyl blocking groups is that both blocking and de-blocking reactions are high-yield reactions and often quantitative.

Although silylation techniques have found application in a wide range of synthetic designs and technologies, silyl blocking groups have heretofore not been effectively employed in protecting the materials of photothermographic and dry-developable imaging. Successful blocking and release of the photothermographically useful materials allows for improved color and black-and-white photothermographic products.

SUMMARY OF THE INVENTION

In one embodiment, the present invention provides heat-developable, photothermographic elements comprising a support bearing at least one photosensitive, image-forming photothermographic emulsion layer comprising:

(a) a photosensitive silver halide;
(b) a non-photosensitive, reducible silver source;
(c) a reducing agent for the non-photosensitive, reducible silver source;
(d) a binder; and
(e) a compound capable of releasing, in the presence of a source of fluoride ion, a photothermographically useful material AH, which is not a reducing agent for the non-photosensitive, reducible silver source, the compound having the formula:

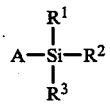

wherein:

$R^1$, $R^2$, and $R^3$ independently represent hydrogen, an alkyl group, an aryl group, an aralkyl group, an alkaryl group, or an alkenyl group; preferably, $R^1$, $R^2$, and $R^3$ independently represent a $C_1$ to $C_{12}$ alkyl, aryl, aralkyl, alkaryl, or alkenyl group; and more preferably, $R^1$, $R^2$, and $R^3$ independently represent a $C_1$ to $C_6$ alkyl, aryl, aralkyl, alkaryl, or alkenyl group; and A represents a photothermographically useful group in which a hydrogen atom of the photothermographically useful material AH, which is not a reducing agent for the non-photosensitive, reducible silver source, has been replaced by:

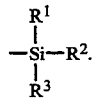

In another embodiment, the present invention provides a heat-developable, photothermographic element comprising a support bearing at least one photosensitive, image-forming photographic emulsion layer comprising:

(a) a photosensitive silver halide;
(b) a non-photosensitive, reducible silver source;
(c) a binder; and
(d) a compound capable of releasing, in the presence of a source of fluoride ion, a reducing agent for said non-photosensitive, reducible silver source, said compound having the formula:

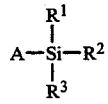

wherein:

$R^1$, $R^2$, and $R^3$ independently represent hydrogen, an alkyl group, an aryl group, an aralkyl group, an alkaryl group, or an alkenyl group; preferably, $R^1$, $R^2$, and $R^3$ independently represent a $C_1$ to $C_{12}$ alkyl, aryl, aralkyl, alkaryl, or alkenyl group; and more preferably, $R^1$, $R^2$, and $R^3$ independently represent a $C_1$ to $C_6$ alkyl, aryl, aralkyl, alkaryl, or alkenyl group; and A represents a group in which a hydrogen atom of the corresponding compound AH, which is a reducing agent for the non-photosensitive, reducible source of silver, has been replaced by:

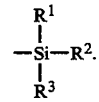

In the formulas above, A represents any monovalent group for which the corresponding compound AH functions as a photothermographically useful material having from 1 to 50 carbon atoms. The A groups may, of course, independently bear substituents that am photographically inert or physically useful (e.g., solubilizing, ballasting, etc.) and the substituent may be independently represented by a group R selected from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonio, phosphonio, silyl, and silyloxy groups having up to 18 carbon atoms, and wherein any two or three R groups may together form a fused ring structure with any central benzene ring.

The reducing agent for the non-photosensitive silver source may optionally comprise a compound capable of being oxidized to form or release a dye. Preferably the dye forming material is a leuco dye.

The compounds of the present invention typically comprise from about 0.01 wt. % to 10 wt. % of the dry photothermographic composition. They may be incorporated directly into the silver containing layer or into an adjacent layer. The photothermographically useful materials of the invention are especially useful in elements and compositions for the preparation of photothermographic color and photothermographic black-and-white images.

The silyl-protected compounds of the present invention can be used in color and black-and-white photothermographic imaging systems such as so called "Dry Silver" materials. In such systems, materials contained therein have active (i.e., acidic) hydrogens which affect stability and sensitometric parameters. These active hydrogen-containing materials can represent a stabilizer, developer (including a leuco dye), toner, activator, etc.

The release of photothermographically useful materials such as stabilizers, leuco dyes, developers, toners, etc., from their blocked siloxane precursor(s) can be effected by heating the blocked stabilizers, developers, toners, etc., with a fluoride ion generator. In one preferred procedure, the invention uses inexpensive, nontoxic, and readily available alkali metal salts of perfluorinated complex anions as potential source of fluoride-ion. The blocking group is released in the form of its silylfluoride.

The silyl-protected compounds of this invention are believed to be deblocked to release photothermographically useful groups by the action of fluoride ion, moisture, heat, or a combination thereof. The silyl-protected groups offer advantages over photothermographically useful groups released by other mechanisms by being inert and inactive during the processing step, and being resistant to thermal release during shelf aging. The photothermographically useful material is released only when needed. They are useful in a wide range of photothermographic media and processing conditions since they do not appear to have specific requirements for release that attend most other blocking groups.

A preferred method of deblocking the silyl group uses fluoride ion. The fluoride ion source can come from an alkali fluoride, an alkali metal salt of a perfluorinated complex anion, or an organic fluoride. Exemplary fluoride sources are potassium fluoride, tetrabutylammonium fluoride, benzoyl fluoride, cyanuric fluoride, $BF_4^-$, $PF_6^-$, $SbF_6^-$, $KF{\cdot}2H_2O$, and $KSO_2F$. This invention is not restricted to these examples alone, but is meant to be inclusive of other known fluoride sources. The fluoride source and compound capable of releasing a photothermographically useful material can remain stable indefinitely during storage. When heated, the salt releases a fluoride ion which reacts with the silane, de-blocks the silyl group, and releases the photothermographically useful material.

A preferred use of compounds of this invention is as post-processing stabilizers for photothermographic materials. When so used, compounds of the invention provide improved post-processing image stability with little or no effect on initial sensitometry.

Another preferred use of compounds of this invention is as a blocking agent for reducing agents for the non-photosensitive reducible silver source. Materials of this type are also known as "silver developers," or developers.

The addition of silyl-blocked compounds to the photothermographic emulsion layer or layer adjacent to the emulsion layer in the presence of a fluoride ion source minimizes untimely leuco oxidation or stabilizes the silver halide for improved post-processing stabilization without desensitization or fogging the heat developable photographic material and process.

As used herein, the term "emulsion layer" means a layer of a photothermographic element that contains photosensitive silver salt and silver source material.

As is well understood in this technical area, a large degree of substitution is not only tolerated, but is also often advisable and substitution is anticipated on the compounds of the present invention. As a means of simplifying the description of substituent groups, the terms "group" (or "nucleus") and "moiety" are used to differentiate between those chemical species that may be substituted and those which may not be so substituted. Thus, when the term "group," "aryl group," or "central nucleus" is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. For example, alkyl group includes ether groups (e.g., $CH_3—CH_2—CH_2—O—CH_2—$), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents which react with active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims.

DETAILED DESCRIPTION OF THE INVENTION

The present invention provides heat-developable, photothermographic elements capable of providing stable, high density images of high resolution. These heat-developable, photothermographic elements comprising a support bearing at least one photosensitive, image-forming photothermographic-emulsion layer comprising:

(a) a photosensitive silver halide;

(b) a non-photosensitive, reducible silver source;

(c) a reducing agent for the non-photosensitive, reducible silver source;

(d) a binder; and (e) a compound capable of releasing, in the presence of a source of fluoride ion, a photothermographically useful material AH, which is not a reducing agent for the non-photosensitive, reducible silver source, the compound having the formula:

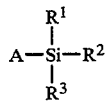

wherein:

$R^1$, $R^2$, and $R^3$ independently represent hydrogen, an alkyl group, an aryl group, an aralkyl group, an alkaryl group, or an alkenyl group; preferably, $R^1$, $R^2$, and $R^3$ independently represent a $C_1$ to $C_{12}$ alkyl, aryl, aralkyl, alkaryl, or alkenyl group; and more preferably, $R^1$, $R^2$, and $R^3$ independently represent a $C_1$ to $C_6$ alkyl, aryl, aralkyl, alkaryl, or alkenyl group; and A represents a photothermographically useful group in which a hydrogen atom of the photothermographically useful material AH, which is not a reducing agent for said non-photosensitive, reducible silver source, has been replaced by:

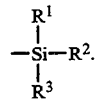

In another embodiment, the present invention provides a heat-developable, photothermographic element comprising a support bearing at least one photosensitive, image-forming photographic emulsion layer comprising:

(a) a photosensitive silver halide;

(b) a non-photosensitive, reducible silver source;

(c) a binder; and (d) a compound capable of releasing, in the presence of a source of fluoride ion, a reducing agent for said non-photosensitive, reducible silver source, said compound having the formula:

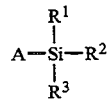

wherein:

$R^1$, $R^2$, and $R^3$ independently represent hydrogen, an alkyl group, an aryl group, an aralkyl group, an alkaryl group, or an alkenyl group; preferably, $R^1$, $R^2$, and $R^3$ independently represent a $C_1$ to $C_{12}$ alkyl, aryl, aralkyl, alkaryl, or alkenyl group; and more preferably, $R^1$, $R^2$, and $R^3$ independently represent a $C_1$ to $C_6$ alkyl, aryl, aralkyl, alkaryl, or alkenyl group; and A represents a group in which a hydrogen atom of the corresponding compound AH, which is a reducing agent for the non-photosensitive, reducible source of silver, has been replaced by:

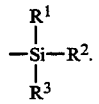

In the formulas above, A represents any monovalent group for which the corresponding compound AH functions as a photothermographically useful material having from 1 to 50 carbon atoms. The A groups may of course independently bear substituents that are photographically inert or physically useful (e.g., solubilizing, ballasting, etc.) and the substituent may be independently represented by a group R selected from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonio, phosphonio, silyl, and silyloxy groups having up to 18 carbon atoms in any one of these groups, and wherein any two or three R groups may together form a fused ring structure with any central benzene ring.

In photothermographic elements of the present invention, the layer(s) that contain the photographic silver salt are referred to herein as emulsion layer(s). According to the present invention, d the blocked photothermographically useful material is added either to one or more emulsion layers or to a layer or layers adjacent to one or more emulsion layers. Layers that are adjacent to emulsion layers may be, for example, primer layers, image-receiving layers, interlayers, opacifying layers, antihalation layers, barrier layers, auxiliary layers, etc.

The silyl group acts as a blocking group to inhibit or suppress the activity of the photothermographically useful group, AH. If AH is left unblocked and added to the photothermographic emulsion at the same molar equivalent concentration as the blocked compound, AH desensitizes, fogs, reacts with, or otherwise destabilizes or has a deleterious effect on the emulsion or its photothermographic properties. Deblocking to release the active photothermographically useful material occurs after exposure and during development at elevated temperatures. Thus, the blocked photothermographically useful materials of the present invention overcome the problems of desensitization, fogging, and instability of the emulsion that occur when the photothermographically useful materials are used in their unblocked form.

A is preferably attached to the hydrogen atom through a nitrogen or an oxygen atom.

In one embodiment, the group A represents the nucleus of a post-processing stabilizing group for stabilizing unreacted leuco dye. Often unreacted leuco dye may slowly oxidize and form areas of color in the non exposed areas. Such stabilizers prevent "leuco dye backgrounding." In such stabilizing groups, AH usually has a hetero-atom such as nitrogen or oxygen available for complexing silver ion. The compounds are usually ring structures with the heteroatom within the ring or external to the ring. These compounds are well known to one of ordinary skill in the photographic arts. Non-limiting examples of AH include nitrogen containing heterocycles, substituted or unsubstituted, including but not limited to, imidazoles such as benzimidazole and benzimidazole derivatives; triazoles such as benzotriazole, 1,2,4-triazole, 3-amino-1,2,4-triazole, and 2-thioalkyl-5-phenyl-1,2,4-triazoles; tetrazoles such as 5-aminotetrazole and phenylmercaptotetrazole; triazines such as mercaptotetrahydrotriazine; piperidones; tetrazaindans; 8-azaguanine; thymine; thiazolines such as 2-amino-2-thiazoline, indazoles; hypoxanthines; pyrazolidinones; 2H-pyridooxazin-3(4H)-one and other nitrogen containing heterocycles; or any such compound that stabilizes the emulsion layer, and particularly those that have deleterious effects on the initial sensitometry or excessive fog if used unblocked.

Many of such stabilizer compounds are summarized in *Research Disclosure,* March 1989, item 29963. AH may also be a compound which stabilizes a leuco dye, usually a reducing agent which has an active hydrogen which can be masked by replacement with the blocking group. An example of a useful reducing agent is 1-phenyl-3-pyrazolidinone (described in U.S. Pat. No. 4,423,139 for stabilizing leuco dyes). Masking of such reducing agents during the processing step is usually necessary since they may act as developers or development accelerators to cause unacceptable fogging.

Non-limiting representative examples of stabilizer groups A- for preventing "leuco dye backgrounding" according to the present invention are:

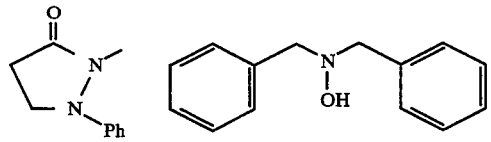

In another embodiment, the group A- represents the nucleus of a post-processing stabilizing group for stabilizing silver ion. Such stabilizers prevent "fogging" or "silver print-out" of the emulsion after coating. In this situation, non-limiting representative examples of stabilizer groups A- include:

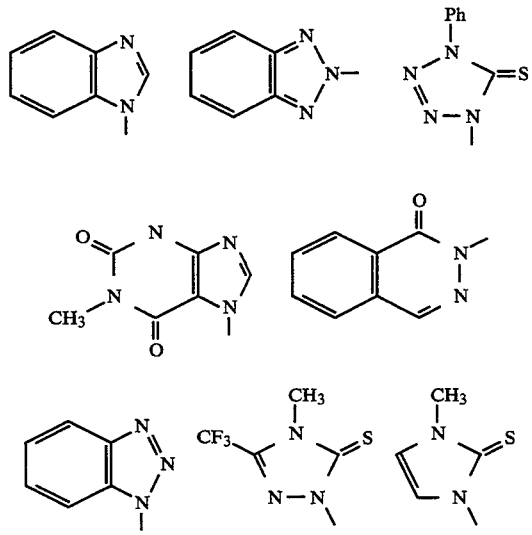

When used as post-processing stabilizers in photothermographic elements, the photothermographically useful materials of the invention may contain other post-processing stabilizers or stabilizer precursors in combination with the compounds of the invention, as well as other additives in combination with the compound of the invention such as shelf-life stabilizers, toners, development accelerators, and other image-modifying agents.

The amounts of the above-described post-processing stabilizer ingredients that are added to the emulsion layer according to the present invention may be varied depending upon the particular compound used an upon the type of emulsion layer (i.e., black-and-while or color). However, the ingredients are preferably added in an amount of 0.01 to 100 mole per mole of silver halide, and more preferably from 0.1 to 50 mole per mole of silver halide, in the emulsion layer.

In a further embodiment, the group A- represents a developer for the non-photosensitive reducible silver source. A non-limiting representative example of a developer for the non-photosensitive reducible silver source is:

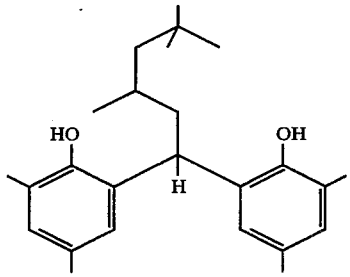

In another embodiment, the group A represents the nucleus of a leuco dye.

The photothermographic elements of this invention may be used to prepare black-and-white, monochrome, or full color images. The photothermographic material of this invention can be used, for example, in conventional black-and-white or color photothermography, in electronically generated black and white or color hard-copy recording, in the graphic arts area, and in digital color proofing. The material of this invention provides high photographic speed, provides strongly absorbing black-and-white or color images, and provides a dry and rapid process.

The silyl-protected compounds of the present invention can be used in color and black-and-white photothermographic imaging systems such as so called "Dry Silver" materials. In such systems, materials contained therein have active hydrogen(s) which affect stability and sensitometric parameters. These compounds can represent a stabilizer, developer, toner/activator, leuco dye, etc.

Non-limiting examples of protected photothermographically useful materials according to the present invention are shown below. Compounds 1–5 are silyl-blocked stabilizers and are used in color photothermographic constructions to prevent leuco dye oxidation in non-exposed areas. Compound 6 is a silyl-blocked reducing agent and is used to prevent silver development in non-exposed areas in black-and-white photothermographic constructions.

Compound 1

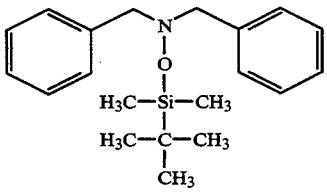

-continued

Compound 2

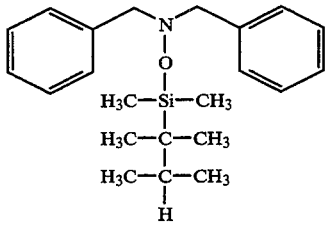

Compound 3

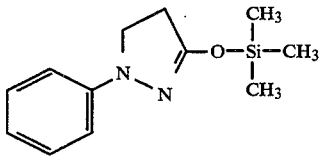

Compound 4

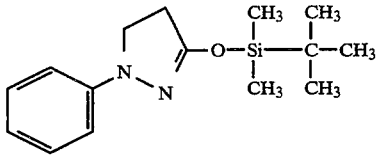

Compound 5

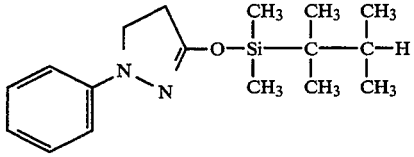

Compound 6

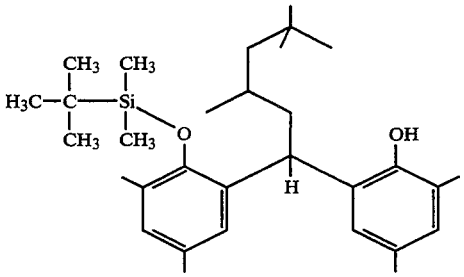

The Photosensitive Silver Halide

The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The light sensitive silver halide used in the present invention can be employed in a range of 0.005 mole to 0.5 mole and, preferably, from 0.01 mole to 0.15 mole per mole of silver salt. The silver halide may be added to the emulsion layer in any fashion which places it in catalytic proximity to the silver source.

The silver halide used in the present invention may be employed without modification. However, it can be chemically and spectrally sensitized in a manner similar to that used to sensitize conventional wet process silver halide or state-of-the-art heat-developable photographic materials. For example, it may be chemically sensitized with a chemical sensitizing agent such as a compound containing sulfur, selenium or tellurium etc., or a compound containing gold, platinum, palladium, ruthenium, rhodium or iridium, etc., a reducing agent such as a tin halide, etc., or a combination thereof. The details of these procedures are described in T. H. James *The Theory of the Photographic Process,* Fourth Edition, Chapter 5, pages 149 to 169. Suitable chemical sensitization procedures are also described in U.S. Pat. Nos. 1,623,499 to Shepard; 2,399,083 to Waller; 3,297,447 to McVeigh; and 3,297,446 to Dunn.

The photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ mol mole of silver halide.

The Non-Photosensitive Reducible Silver Source Material

The non-photosensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkylthioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen-substituted benzotriazole, such as a silver salt of 5-chlorobenzotriazole, etc., a silver salt of 1,2,4-triazole, of 1H-tetrazole as described in U.S. Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* April 1983 (22812), *Research Disclosure* October 1983 (23419) and U.S. Pat. No. 3,985,565.

The silver halide may be pre-formed and mixed with the organic silver salt in a binder prior to use to prepare a coating solution. It is also effective to blend the silver halide and organic silver salt in a ball mill for a long period of time. Materials of this type are often referred to as pre-formed emulsions. It is also effective to use an in situ process which comprises adding a halogen-containing compound to the organic silver salt to partially convert the silver of the organic silver salt to silver halide.

Methods of preparing these silver halide and organic silver salts and manners of blending them are described in Research Disclosures, No. 170-29, Japanese patent applications No. 32928/75 and 42529/76, U.S. Pat. No. 3,700,458, and Japanese patent applications Nos. 13224/74 and 17216/75.

Pre-formed silver halide emulsions in the material of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. Nos. 2,618,556;

Yutzy et al., 2,614,928; Yackel, 2,565,418; Hart et at., 3,241,969; and Waller et al., 2,489,341. The silver halide grains may have any crystalline habit including, but not limited to, cubic, tetrahedral, orthorhombic, tabular, laminar, platelet, etc.

The silver halide and the non-photosensitive reducible silver source material that form a starting point of development should be in reactive association. By "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing preformed silver halide in accordance with this invention can be sensitized with chemical sensitizers, or with spectral sensitizers as described above.

The source of reducible silver material generally constitutes from 15 to 70 percent by weight of the emulsion layer. It is preferably present at a level of 30 to 55 percent by weight of the emulsion layer.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered phenol reducing agents are preferred.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyanophenylacetic acid derivatives such as ethyl α-cyano-2-methylphenylacetate, ethyl α-cyano-phenylacetate; bis-o-naphthols as illustrated by 2,2'-dihydroxy-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidone-hexose reductone; sulfamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl--6-hydroxychroman; 1,4-dihydropyridines such as 2,6-dimethoxy-3,5-dicarbethoxy-1,4-dihydropyridine; bisphenols, e.g., bis(2-hydroxy-3-t-butyl-5-methyl phenyl) methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl)propane; ascorbic acid derivatives, e.g., 1-ascorbylpalmitate, ascorbylstearate and unsaturated aldehydes and ketones, such as benzyl and diacetyl; 3-pyrazolidones; and certain indane-1,3-diones.

The reducing agent should be present as 1 to 12 percent by weight of the imaging layer. In multilayer constructions, if the reducing agent is added to a layer other than an emulsion layer, slightly higher proportions, of from about 2 to 15 percent, tend to be more desirable.

The Optional Dye Releasing Material

As noted above, the reducing agent for the reducible source of silver may be a compound that can be oxidized to form or release a dye.

Leuco dyes are one class of dye releasing material that forms a dye upon oxidation. The optional leuco dye may be any colorless or lightly colored compound that can be oxidized to a colored form, when heated, preferably to a temperature of from about 80° C. to about 250° C. (176° F. to 482° F.) for a duration of from about 0.5 to about 300 seconds and can diffuse through emulsion layers and interlayers into the image receiving layer of the dement of the invention. Any leuco dye capable of being oxidized by silver ion to form a visible image can be used in the present invention. Leuco dyes that are both pH sensitive and oxidizable can be used but are not preferred. Leuco dyes that are sensitive only to changes in pH are not included within scope of dyes useful in this invention because they are not oxidizable to a colored form.

As used herein, the term "change in color" includes (1) a change from an uncolored or lightly colored state (optical density less than 0.2) to a colored state (an increase in optical density of at least 0.2 units), and (2) substantial change in hue.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylenediamine with a phenolic or anilinic compound. Leuco dyes of this class are described in U.S. Pat. No. 4,594,307. Leuco chromogenic dyes having short chain carbamoyl protecting groups are described in copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Patent No. 52-89131 and U.S. Pat. Nos. 2,784,186; 4,439,280; 4,563,415; 4,570,171; 4,622,395; and 4,647,525.

Another class of dye releasing materials that form a dye upon oxidation are known as pre-formed-dye-release (PDR) or redox-dye-release (RDR) materials. In these materials the reducing agent for the organic silver compound releases a preformed dye upon oxidation. Examples of these materials are disclosed in Swain, U.S. Pat. No. 4,981,775.

Also useful are neutral, phenolic leuco dyes such as 2-(3,5-di-t-butyl-4-hydroxyphenyl)-4,5,-diphenylimidazole, or bis(3,5-di-t-butyl-4-hydroxyphenyl) phenylmethane. Other phenolic leuco dyes useful in practice of the present invention are disclosed in U.S. Pat. Nos. 4,374,921; 4,460,681; 4,594,307; and 4,782,010.

The dyes formed from the leuco dye in the various color-forming layers should, of course, be different. A difference of at least 60 nm in reflective maximum absorbance is preferred. More preferably, the absorbance maximum of dyes formed will differ by at least 80–100 nm. When three dyes are to be formed, two should preferably differ by at least these minimums, and the third should preferably differ from at least one of the other dyes by at least 150 nm, and more preferably, by at least 200 nm. Any leuco dye capable of being oxidized by silver ion to form a visible dye is useful in the present invention as previously noted.

Other leuco dyes may be used in imaging layers as well, for example, benzylidene leuco compounds cited in U.S. Pat. No. 4,923,792, incorporated herein by reference. The reduced form of the dyes should absorb less strongly in the visible region of the electromagnetic spectrum and be oxidized by silver ions back to the original colored form of the dye. Benzylidene dyes have extremely sharp spectral characteristics giving high color purity of low gray level. The dyes have large extinction coefficients, typically on the order of $10^4$ to $10^5$ liter/mole-cm, and possess good compatibility and heat stability. The dyes are readily synthesized and the reduced leuco forms of the compounds are very stable. Leuco dyes such as those disclosed in U.S. Pat. Nos. 3,442,224; 4,021,250; 4,022,617; and 4,368,247 are also useful in the present invention.

The dyes generated by the leuco compounds employed in the elements of the present invention are known and are disclosed, for example, in *The Colour Index;* The Society of Dyes and Colourists: Yorkshire, England, 1971; Vol. 4, p. 4437; and Venkataraman, K. *The Chemistry of Synthetic Dyes;* Academic Press: New York, 1952; Vol. 2, p. 1206; U.S. Pat. No. 4,478,927, and Hamer, F. M. *The Cyanine Dyes and Related Compounds;* Interscience Publishers: New York, 1964; p. 492.

Leuco dye compounds may readily be synthesized by techniques known in the art. Suitable methods are disclosed, for example, in: F. X. Smith et al. *Tetrahedron Lett.* 1983, 24(45), 4951–4954; X. Huang., L. Xe, *Synth. Commun.* 1986, 16(13) 1701–1707; H. Zimmer et at. *J. Org. Chem.* 1960, 25, 1234–5; M. Sekiya et al. *Chem. Pharm. Bull.* 1972, 20(2),343; and T. Sohda et al. *Chem. Pharm. Bull.* 1983, 31(2) 560-5; H. A. Lubs *The Chemistry of Synthetic Dyes and Pigments;* Hafner; New York, N.Y.; 1955 Chapter 5; in H. Zollinger *Color Chemistry: Synthesis, Properties and Applications of Organic Dyes and Pigments*; VCH; New York, N.Y.; pp. 67–73, 1987, and in U.S. Pat. No. 5,149,807; and EPO Laid Open Application No. 0,244,399.

Further, as other image forming materials, materials where the mobility of the compound having a dye part changes as a result of an oxidation-reduction reaction with silver halide, or an organic silver salt at high temperature can be used, as described in Japanese Patent Application No. 165054 (1984). Many of the above-described materials are materials wherein an imagewise distribution of mobile dyes corresponding to exposure is formed in the photosensitive material by heat development. Processes of obtaining visible images by transferring the dyes of the image to a dye fixing material (diffusion transfer) have been described in the above described cited patents and Japanese Patent Application Nos. 168,439 (1984) and 182,447 (1984).

Still further the reducing agent may be a compound that releases a conventional photographic dye coupler or developer on oxidation as is known in the art. When the heat developable, photosensitive material used in this invention is heat developed in a substantially water-free condition after or simultaneously with imagewise exposure, a mobile dye image is obtained simultaneously with the formation of a silver image either in exposed areas or in unexposed areas with exposed photosensitive silver halide.

The total amount of optional leuco dye used as a reducing agent utilized in the present invention should preferably be in the range of 0.5–25 weight percent, and more preferably in the range of 1–10 weight percent, based upon the total weight of each individual layer in which the reducing agent is employed.

The Binder

It is preferred that the binder be sufficiently polar to hold the other ingredients of the emulsion in solution. It is preferred that the binder be selected from polymeric materials, such as, for example, natural and synthetic resins, such as gelatin, polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred. The binders can be used individually or in combination with one another. Although the binder may be hydrophilic or hydrophobic; it is preferably hydrophobic.

The binders are generally used at a level of from about 20 to about 80 percent by weight of the emulsion layer, and preferably from about 30 to about 55 percent by weight. Where the proportions and activities of the components require a particular developing time and temperature, the binder should be able to withstand those conditions. Generally, it is preferred that the binder not decompose or lose its structural integrity at 200° F. (90° C.) for 30 seconds, and more preferred that it not decompose or lose its structural integrity at 300° F. (149° C.) for 30 seconds.

Optionally these polymers may be used in combination of two or more thereof. Such a polymer is used in an amount sufficient to carry the components dispersed therein, that is, within the effective range of the action as the binder. The effective range can be appropriately determined by one skilled in the art.

Dry Silver Formulations

The formulation for the photothermographic emulsion layer can be prepared by dissolving and dispersing the binder, the photosensitive silver halide, the non-photosensitive source of reducible silver, the reducing agent for the non-photosensitive reducible silver source (as, for example, the optional leuco dye), and optional additives, in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10 percent by weight of the emulsion layer, preferably from 0.1 to 10 percent by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl- 1,2,4-triazole and 2,5-dimercapto-1,3,4-thiadiazole; N-(aminomethyl-)aryldicarboximides, e.g. (N,N-dimethylaminomethyl)-phthalimide, and N-(dimethylaminomethyl)-naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium)trifluoroacetate and 2-(tribromomethylsulfonyl benzothiazole); and merocyanine dyes such as 3-ethyl-5-[(3-ethyl-2-benzothiazolinylidene)-1-methyl-ethylidene]-2-thio-2,4-o-azolidinedione; phthal-azinone, phthalazinone derivatives or metal salts or these derivatives such as 4-(1-naphthyl)-phthalazinone, 6-chlorophthalazinone, 5,7-dimethoxyphthalazinone, and 2,3-dihydro-1,4-phthalazinedione; a combination of phthalazinone plus sulfinic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro- 1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H, 4H-2,3a,5,6a-tetrazapentalene, and 1,4-di-(o-chlorophenyl)-3,6-dimercapto-1H,4H-2,3a,5,6a-tetrazapentalene.

Silver halide emulsions used in this invention may be protected further against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mercuric acetate and mercuric bromide.

Suitable antifoggants and stabilizers which can be used alone or in combination, include the thiazolium salts described in U.S. Pat. Nos. 2,131,038 to Staud and 2,694,716, to Allen; the azaindenes described in U.S. Pat. Nos. 2,886,437 to Piper, and 2,444,605, to Heimbach; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in U.S. Pat. Nos. 2,566,263 to Trivelli, and 2,597,915 to Damschroder.

Stabilized emulsions used in the invention can contain plasticizers and lubricants such as polyalcohols, e.g., glycerin and diols of the type described in Milton, U.S. Pat. No. 2,960,404; fatty acids or esters such as those described in U.S. Pat. Nos. 2,588,765 to Robins, and 3,121,060, to Duane; and silicone resins such as those described in DuPont British Patent No. 955,061.

The photothermographic elements can include image dye stabilizers. Such 20 image dye stabilizers are illustrated by U.K. Patent No. 1,326,889; and U.S. Pat. Nos. 3,432,300; 3,698,909; 3,574,627; 3,573,050; 3,764,337; and 4,042,394.

Photothermographic elements containing stabilized emulsion layers can be used in photographic elements which contain light absorbing materials and filter dyes such as those described in Sawdey, U.S. Pat. Nos. 3,253,921, to Sawdey; 2,274,782, to Gaspar; 2,527,583 to Carroll, and 2,956,879 to Van Campen. If desired, the dyes can be mordanted, for example, as described in Milton, U.S. Pat. No. 3,282,699.

Photothermographic elements containing stabilized emulsion layers can contain matting agents such as starch, titanium dioxide, zinc oxide, silica, polymeric beads including beads of the type described in U.S. Pat. Nos. 2,992,101 to Jelly, and 2,701,245 to Lynn.

Stabilized emulsions can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The photothermographic dry silver emulsions of this invention may be constructed of one or more layers on a substrate. Single layer constructions should contain the silver source material, the silver halide, the developer, and binder as well as optional materials such as toners, coating aids, and other adjuvants. Two-layer constructions should contain the silver source and silver halide in one emulsion layer (usually the layer adjacent to the substrate) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic elements, the various emulsion layers are generally maintained distinct from each other by the use of functional or non-functional barrier layers between the various photosensitive layers as described in U.S. Pat. No. 4,460,681.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

The Support

Photothermographic emulsions used in the invention can be coated on a wide variety of supports. The support or substrate can be selected from a wide range of materials depending on the imaging requirement. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an α-olefin polymer, particularly a polymer of an alpha-olefin containing 2 to 10 carbon atoms such as polyethylene, polypropylene, ethylene butene copolymers and the like. Preferred polymeric materials for the support include polymers having good heat stability, such as polyesters. A particularly preferred polyester is polyethylene terephthalate.

Photothermographic emulsions used in this invention can be coated by various coating procedures including, wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to about 100 micrometers (μm), and the layer can be dried in forced air at temperatures ranging from 20° C. to 100° C. It is preferred that the thickness of the layer be selected to provide maximum image densities greater than 0.2, and more preferably in the range 0.5 to 2.5, as measured by a MacBeth Color Densitometer Model TD 504 using the color filter complementary to the dye color.

Alternatively, the formulation may be spray-dried or encapsulated to produce solid particles, which can then be re, dispersed in a second, possibly different, binder and then coated onto the support.

The formulation for the emulsion layer can also include coating aids such as fluoroaliphatic polyesters.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

The substrate with backside resistive heating layer may also be used in color photothermographic imaging systems such as shown in U.S. Pat. Nos. 4,460,681 and 4,374,921.

The Image-Receiving Layer

The photothermographic element may further comprise an image-receiving layer. Images derived from the photothermographic elements employing compounds capable of being oxidized to form or release a dye, as for example, leuco dyes are typically transferred to an image-receiving layer.

When the reactants and reaction products of photothermographic systems that contain compounds capable of being oxidized to form or release a dye remain in contact after imaging, several problems can result. For example, thermal development often forms turbid and hazy color images because of dye contamination of the reduced metallic silver image on the exposed area of the emulsion. In addition, the resulting prints tend to develop color in unimaged background areas. This "background stain" is caused by slow reaction between the dye forming or dye releasing compound and reducing agent during storage. It is therefore desirable to transfer the dye formed upon imaging to a receptor, or image receiving layer.

The image-receiving layer of this invention can be any flexible or rigid, transparent layer made of thermoplastic polymer. The image-receiving layer preferably has a thickness of at least 0.1 micrometer, more preferably from about 1 to about 10 micrometers, and a glass transition temperature of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably from 1.5 to 3.5) or a transmission optical density in the range of from 0.2 to 2.5 (preferably from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyester is "Fluorad FC 431", (a fluorinated surfactant, available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion laver to facilitate transfer of the dye that forms after the imagewise exposed emulsion layer is subjected to thermal development, for example, in a heated shoe-and-roller type heat processor.

Multi-layer constructions containing blue-sensitive emulsions containing a yellow leuco dye of this invention may be overcoated with green-sensitive emulsions containing a magenta leuco dye of this invention. These layers may in turn be overcoated with a red-sensitive emulsion layer containing a cyan leuco dye. Imaging and heating form the yellow, magenta, and cyan images in an imagewise fashion. The dyes so formed may migrate to an image receiving layer. The image receiving layer may be a permanent part of the construction or may be removable "i.e., strippably adhered" and subsequently peeled from the construction. Color forming layers may be maintained distinct from each other by the use of functional or non-functional barrier layers between the various photosensitive layers as described in U.S. Pat. No. 4,460,681. False color address, such as that shown in U.S. Pat. No. 4,619,892, may also be used rather than blue-yellow, green-magenta, or red-cyan relationships between sensitivity and dye formation.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Multi-color images can be prepared by superimposing in register, imaged image-receiving layers as prepared above. The polymers of the individual imaged image-receiving layers must be sufficiently adherent to provide useful multi-color reproduction on a single substrate.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXAMPLES

These examples provide exemplary synthetic procedures for compounds of the invention. Photothermographic imaging constructions are shown. The scope of the invention is not to be limited to the specific examples.

All materials used in the following examples were readily available from standard commercial sources such as Aldrich Chemical Co. (Milwaukee, Wis.) unless otherwise specified. The following additional terms and materials were used.

Acryloid TM B-66 is a poly(methyl methacrylate) available from Rohm and Haas.

Airvol TM 523 is a poly(vinyl alcohol) available from Air Products.

Butvar TM B-76 is a poly(vinyl butyral) available from Monsanto Company, St. Louis, Mo.).

FC-431 is a flurochemical surfactant available from 3M Company, St. Paul, Minn.

$HgC_2HsO_2$ is mercuric acetate.

MEK is methyl ethyl ketone (2-butanone).

PAZ is 1-(2H)-phthalazinone.

Permanax WSO is 1,1-bis(2-hydroxy-3,5-dimethylphenyl)-3,5,5-trimethylhexane [CAS RN=7292-14-0] and is available from Vulnax International, Ltd. It is also known as Nonox.

PET is poly(ethylene terephthalate).

PVP K-90 is a poly(vinyl pyrrolidone) available from International Specialty Products.

Styron TM 685 is a polystyrene resin available from Dow Chemical Company.

VAGH is a vinyl chloride/vinyl acetate copolymer available from Union Carbide Corp.

Evaluation of Stabilizers

Densitometry measurements were made on a custom built computer scanned densitometer and are believed to be comparable to measurements obtainable from commercially available densitometers.

The Green filter used was a Wratten #58.

The Blue filter used was a Wratten #47B.

The Red filter used was a Wratten #25.

The compounds reported herein have been synthesized by modifying literature procedures used for the preparation of similar materials. Compounds 1–5 are used as reducing agents to prevent cyan leuco oxidation in non-exposed areas in color photothermographic constructions. Phenidones, Compounds 3–5, are also used as color photothermographic developers. Compound 6 is used as a developer in black-and-white photothermographic constructions.

Precursor hydroxy compounds, hexamethyldisilazane, trimethylchlorosilane, tert-butyl-dimethylchlorosilane, dimethylthexyl chloride, imidazole, and pyridine are available from Aldrich Chemical Company, Milwaukee, Wis. All compounds were characterized by their $^1H$, $^{29}Si$ nmr and by the absence of-OH absorption in the IR spectra. NMR spectra were recorded in a 400 MHz superconducting nmr spectrometer. IR spectra were recorded in a Nicolet Instrument.

Compound I was prepared by stirring a mixture of dibenzylhydroxylamine, imidazole and tert-butyldimethylchlorosilane in dimethyl formamide (DMF) at ambient temperature under nitrogen blanket for 16 hours followed by addition of a saturated solution of sodium bicarbonate. The product was isolated in 92% yield. Spectral data were in agreement with the proposed structure.

Compound 2 was prepared by stirring a mixture of dibenzylhydroxylamine, imidazole and chlorodimethylthexyl silane [CAS Registry No. 67373-56-2] in dimethyl formamide (DMF) at ambient temperature under nitrogen blanket for 16 hours followed by addition of a saturated solution of sodium bicarbonate. The product was isolated in 95% yield. Spectral data were in agreement with the proposed structure.

Compound 3 was prepared by stirring a mixture of the sodium salt of 1-phenyl-3-pyrazolinone (phenidone), imidazole and trimethylchlorosilane in DMF at ambient temperature under nitrogen blanket for 16 hours followed by addition of a saturated solution of sodium bicarbonate. The sodium salt of phenidone was prepared using methanolic solution of phenidone with sodium methoxide.

Compound 4 was prepared by stirring a mixture of sodium salt of 1-phenyl-3-pyrazolinone (phenidone), imidazole and tert-butyldimethylchlorosilane in DMF at ambient temperature under nitrogen blanket for 16 hours followed by addition of a saturated solution of sodium bicarbonate. The product was isolated in 86% yield. Spectral data were in agreement with the proposed structure. The sodium salt of phenidone was prepared using methanolic solution of phenidone with sodium methoxide.

Compound 5 was prepared by stirring a mixture of sodium salt of 1-phenyl-3-pyrazolinone (phenidone), imidazole and dimethyl-thexyl-chlorosilane in DMF at ambient temperature under nitrogen blanket for 16 hours followed by addition of a saturated solution of sodium bicarbonate. The product was isolated in 91% yield. Spectral data were in agreement with the proposed structure. The sodium salt of phenidone was prepared using methanolic solution of phenidone with sodium methoxide.

Compound 6 was prepared as follows: A 500 ml flask was charged with 19.1 g (0.05 tool)of "Permanax WSO," 17.0 g (0.25 mol)of imidazole, and 120 ml of dimethylformamide (DMF). While stirring under a nitrogen atmosphere, 15.5 g (0.11 mol) of t-butyldimethylsilyl chloride was added and the reaction mixture stirred at room temperature for 16 hr. A saturated solution of sodium bicarbonate (200 ml) was slowly added, followed by addition of 200 ml of water. A white precipitate formed. This was filtered, washed with water, and dried in air to afford 26 g (85% ) of the desired product.

Example 1

This example demonstrates the use of an alkali metal perfluorinated anion to deblock a protected stabilizer.

tert-Butyldimethylsiloxy-N,N-dibenzylamine, Compound 1, was heated with sodium tetrafluoroborate at about 200° C. for 30 minutes. The tert-butyldimethylfluorosilane could be distilled off at 62°–64° C. in 82% yield. N,N-dibenzylhydroxylamine was isolated from the reaction. Similar results were obtained using sodium salts of hexafluorophosphate and hexafluoroantimonate.

Example 2

A dispersion of silver behenate half soap was made at 10% solids in toluene and ethanol by homogenization and contained 1.5% by weight polyvinyl butyral. To 71 g of this silver half soap dispersion was added 200 g of ethanol. After 15 minutes of mixing, 2.6 mL of mercuric bromide (0.19 g/10 mL methanol) was added. Then an additional 2.6 mL of mercuric bromide (0.19 g/10 mL methanol) was added 15 minutes later. After 60 minutes of mixing 24 g of polyvinyl butyral was added.

To 82.7 g of the prepared silver premix described above was added a cyan color-forming leuco dye solution as shown below.

| Component | Amount |
|---|---|
| Leuco Dye A | 0.82 g |
| Toluene | 11.7 g |
| Ethyl methacrylate copolymer (Acryloid B72, Rohm and Haas) | 2.3 g |

Leuco dye A is disclosed in U.S. Pat. No. 4,782,010 and has the following formula:

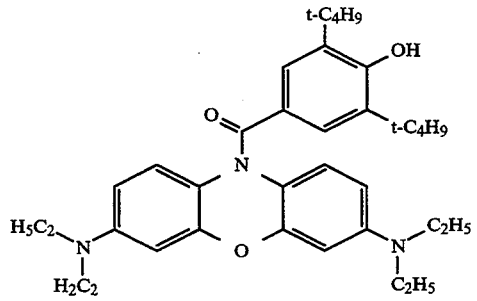

After the addition of the leuco dye premix solution, 1.2 mL of the sensitizing dye B (0.016 g/13 mL methanol+37 mL toluene), shown above, was added and allowed to sensitize for 30 minutes. Sensitizing Dye B is disclosed in U.S. Pat. No. 3,719,495 and has the following formula:

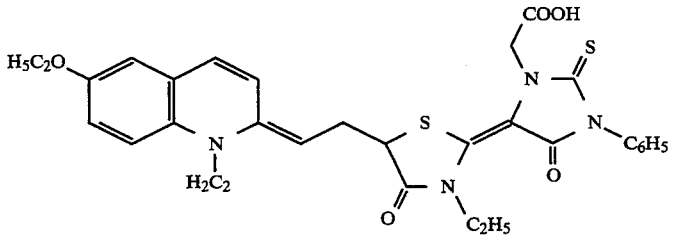

A topcoat solution was prepared containing approximately 17% Scripset 640 (Monsanto, styrene/maleic anhydride copolymer), 1.1% Syloid 244 (colloidal silica, Monsanto), 1.37% phthalic acid, and 0.44% of fluorocarbon surfactant FC-431 in an approximately 50:50 mixture of methanol and ethanol.

To 15.0 g aliquots of the topcoat solution described above was added 0.46% N,N-dibenzylhydroxylamine (Stabilizer C) or 0.76% of Compound 2 (a molar equivalent to Stabilizer C). The structure of Stabilizer C is shown below:

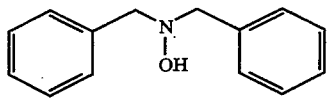

Stabilizer C is a post-processing stabilizer for color photothermographic elements. It prevents oxidation of leuco dye. However, it also fogs the photothermographic emulsion and causes high $D_{min}$ in non-imaged areas.

The cyan silver layer and topcoat were each coated at a wet thickness of 2 mil (50.8 μm) and 1.5 mil (38.1 μm), respectively, and dried for 3 minutes at 82° C. The samples were exposed for $10^{-3}$ seconds through a Wratten #25 filter and 0 to 3 continuous wedge and developed by heating to approximately 138° C. for 6 seconds.

The density of the cyan color for each sample was measured using red filer of a computer densitometer. The initial sensitometric data are shown below. Stabilizer C, N,N-dibenzylhydroxylamine, fogs the emulsion resulting in a high $D_{min}$. Compound 2, silyl-blocked N,N-dibenzylhydroxylamine, gives an image with a $D_{min}$ similar to that of an element with no stabilizer added. Thus, the silyl group blocked the activity of the post-processing stabilizer with little release during processing.

| Example | Filter | $D_{min}$ | $D_{max}$ | Speed[1] | Contrast[2] |
|---|---|---|---|---|---|
| Control - No Additive | Red | 0.16 | 2.01 | 1.89 | 2.20 |
| 0.46% Stabilizer C | Red | 0.33 | 1.97 | 1.83 | 2.24 |
| 0.76% Compound 2 | Red | 0.18 | 2.13 | 1.88 | 2.47 |

*Not a measured parameter
[1]Log exposure corresponding to density of 0.6 above $D_{min}$.
[2]Average contrast measured by the slope of the line joining density points 0.3 and 0.9 above $D_{min}$ for this and subsequent tables.

Post-processing stability was measured by exposing imaged samples to 1200 ft. candles of illumination for 6 and 24 hours at 65% relative humidity and 26.7° C., and for 7 and 14 days at 100 ft. candles of illumination 73% relative humidity and 70° F. (21.1° C.). The post-processing stability results are shown below. Stabilizer C also serves as a post-processing stabilizer and inhibits further oxidation of leuco dye. No post-processing improvements were observed with Compound 2 since successful release of the silyl blocking group requires the presence of a fluoride source.

| | | 1200 ft candles | | 100 ft candles | |
|---|---|---|---|---|---|
| Example | Filter | 6 hrs $\Delta D_{min}$[1] | 24 hrs $\Delta D_{min}$ | 7 days $\Delta D_{min}$ | 14 days $\Delta D_{min}$ |
| Control - No Additive | Red | +0.32 | +0.82 | +0.57 | +0.70 |
| 0.46% Stabilizer C | Red | +0.20 | +0.58 | +0.37 | +0.45 |
| 0.76% Compound 2 | Red | +0.36 | +0.87 | +0.58 | +0.68 |

[1]$\Delta D_{min} = D_{min}$ Final $- D_{min}$ Initial

Example 3

This example demonstrates was run to determine the effect of various concentration of a fluoride source, such as potassium fluoride ($KF.2H_2O$) or tetrabutylammonium fluoride (TBAF), on the sensitometric response of a photothermographic emulsion.

To 15.0 g aliquots of topcoat solution described in Example 2 were added 0.67% or 2.0% by weight of a 1 molar solution of TBAF, or 0.25% or 0.75% of $KF.2H_2O$. The silver solutions and topcoat were coated, exposed, and processed as described in Example 2.

The density of the cyan color for each sample was measured using the red filter of a computer densitometer. The initial sensitometric response suggests concentrations of less than 0.25% of $KF.2H_2O$ or 2.0% of a 1 molar solution of TBAF may be added with minimal effect on the sensitometric response. Also, no post-processing stability effects were observed at these concentrations.

Example 4

To 15.0 g aliquots of topcoat solution described in Example 2 were added;

a) 0.46% by weight N,N-dibenzylhydroxylamine (Stabilizer C);
b) 0.705% by weight Compound 1 (silyl-blocked N,N-dibenzylhydroxylamine); and
c) 0.705% by weight Compound 1 and 1.5% by weight of a 1 molar solution of TBAF.

The silver dispersion and topcoats were the same as described in Example 2. These were coated, exposed, and processed as described in Example 2.

The density of the cyan color for each sample was measured using the red filter of a computer densitometer. The initial sensitometric data, shown below, suggest that with silyl-blocked Compound 1 the silyl group adequately blocked the release of N,N-dibenzylhydroxylamine. It should be noted that the some premature release of Compound 1 was observed in the sample containing both silyl-blocked Compound 1+1.5% of 1 molar TBAF. These effects can be minimized with lower concentrations of fluoride. This is evidenced by the higher $D_{min}$ of this sample as compared to the coating without the stabilizer immediately after processing.

| Example | Filter | $D_{min}$ | $D_{max}$ | Speed | Contrast |
|---|---|---|---|---|---|
| Control - No Additive | Red | 0.15 | 2.25 | 1.91 | 2.41 |
| 0.46% Stabilizer C | Red | 0.34 | 2.16 | 1.88 | 2.30 |
| 0.705% Compound 1 | Red | 0.16 | 2.17 | 1.92 | 2.39 |
| 0.705% Compound 1 + 1.5% 1M TBAF | Red | 0.24 | 2.00 | 1.98 | 2.09 |

The post-processing stability was measured as in Example 2. The results are summarized as below.

| | | 1200 ft-candle | | 100 ft-candle | |
|---|---|---|---|---|---|
| Example | Filter | 6 hrs $\Delta D_{min}$[1] | 24 hrs $\Delta D_{min}$ | 7 days $\Delta D_{min}$ | 14 days $\Delta D_{min}$ |
| Control - No Additive | Red | +0.28 | +0.82 | +0.55 | +0.80 |
| 0.46% Stabilizer C | Red | +0.17 | +0.54 | +0.29 | +0.41 |
| 0.705% Compound 1 | Red | +0.34 | +0.81 | +0.45 | +0.59 |
| 0.705% Compound 1 + 1.5% 1M TBAF | Red | +0.25 | +0.67 | +0.33 | +0.45 |

Example 5

The following example demonstrates that the use of lower fluoride concentrations result in reduction of premature release of the stabilizer.

To 15.0 g aliquots of the topcoat solution described in Example 2 were added:

a) 0.705% by weight Compound 1 (silyl-blocked N,N-dibenzylhydroxylamine);
b) 0.76% by weight Compound 2 (silyl-blocked N,N-dibenzylhydroxylamine);
c) 0.705% by weight Compound 1 and 0.5% of a 1M TBAF solution;
d) 0.705% by weight Compound 1 and 1.0% of a 1M TBAF solution.

The silver dispersion and topcoats were mixed, coated, exposed, and processed as described in Example 2. The initial sensitometric results, as shown by the relatively low $D_{min}$ values, indicate that little of Stabilizer C was released appropriately during processing.

| Example | Filter | $D_{min}$ | $D_{max}$ | Speed | Contrast |
|---|---|---|---|---|---|
| Control - No Additive | Red | 0.14 | 1.92 | 2.06 | 2.17 |
| 0.705% Compound 1 | Red | 0.15 | 1.92 | 2.10 | 2.21 |
| 0.76% Compound 2 | Red | 0.14 | 1.90 | 2.11 | 2.15 |
| 0.705% Compound 1 + 0.5% 1M TBAF | Red | 0.19 | 1.97 | 2.07 | 2.03 |
| 0.705% Compound 1 + 1.0% 1M TBAF | Red | 0.22 | 2.06 | 2.11 | 1.98 |

The post-processing stability was measured as described in Example 2. The results are summarized as below. The addition of the fluoride source at a level of 1.0% of 1M of TBAF further released the N,N-dibenzylhydroxylamine upon thermal development and resulted in improved post-processing stabilization.

| | | 1200 ft-candle | | 100 ft-candle | |
|---|---|---|---|---|---|
| Example | Filter | 6 hrs $\Delta D_{min}$[1] | 24 hrs $\Delta D_{min}$ | 7 days $\Delta D_{min}$ | 14 days $\Delta D_{min}$ |
| Control - No Additive | Red | +0.35 | +0.72 | +0.36 | +0.57 |
| 0.705% Compound 1 | Red | +0.34 | +0.77 | +0.32 | +046 |
| 0.76% Compound 2 | Red | +0.34 | +0.74 | +0.37 | +0.53 |
| 0.705% Compound 1 + 0.5% 1M TBAF | Red | +0.29 | +0.67 | +0.32 | +0.47 |
| 0.705% Compound 1 + 1.0% 1M TBAF | Red | +0.26 | +0.62 | +0.36 | +0.40 |

Example 6

The following example demonstrates the use of Compound 6 as a blocked developer (reducing agent for the non-photosensitive reducible silver source) in a black-and-white dry silver photothermographic system.

A photothermographic dry silver black-and-white dispersion was made according to the following procedure:

A silver halide/silver behenate dry soap was prepared by the procedures described in Winslow, U.S. Pat. No. 4,161,408.

A photothermographic emulsion was prepared at 12% solids using 68% 2-butanone and 20% toluene and 0.5% Butwar B-76 poly(vinyl butyral). All percents are by weight.

To 200.0 g of this homogenized photothermographic dispersion was added 40.0 g of 2-butanone and 32.5 g of polyvinyl butyral. The dispersion was stirred for 1 hour at room temperature. The temperature was lowered to 55° F. (12.8° C.) and 0.13 g of pyridinium hydroromide perbromide (PHP) and 1.3 ml of a 10% solution of calcium bromide in methanol were added. Stirring was maintained for 0.5 hr after which the dispersion was allowed to stand at 55° F. (12.8° C.) overnight. The dispersion was allowed to warm to room temperature, stirring was begun, and 7.0 g of Compound 6 was added over 15 minutes. To this was added 1.2 g of 2-(4-chlorobenzoyl)benzoic acid.

The photothermographic emulsion was coated at 4 mil (101.6 μm) wet thickness onto a 5 mil (127 μm) polyester base by means of a knife coater and dried for 4 minutes at 179° F. (81.7° C.).

A control sample containing 4.62 g of Developer D, the unblocked analog of Compound 6, was prepared and coated as above. The structure of Developer D is shown below:

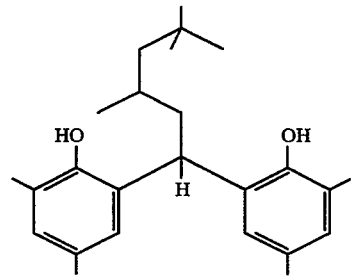

A solution containing $KF.2H_2O$ as the silyl-deblocking agent was prepared by dissolving the following materials:

5.2 wt. % 2-butanone
33.0 wt. % acetone
51.5 wt. % methanol
10.3 wt. % Butvar TM B-76 poly(vinyl butyral)

To 35 g of the above solution was added 0.324 g of $KF.2H_2O$. The solution was coated at 2.0 mil (50.8 μm) wet thickness over the silver emulsion layer and dried for 2.5 minutes at 179° F. (81.7° C.).

A topcoat solution was prepared by mixing the following materials:

55.83 g acetone
27.16 g 2-butanone
10.944 g methanol
5.00 g cellulose acetate (Eastman #398-6)
2.89 g phthalazine
0.302 g 4-methylphthalic acid
0.118 g tetrachlorophthalic acid
0.227 g tetrachlorophthalic anhydride The topcoat solution was then coated over the photothermographic silver layer at a 3 mil (76.2 μm) wet thickness and dried for 3 minutes at 179° F. (81.7° C.).

| Example | Filter | $D_{min}$ | $D_{max}$ | Speed | Contrast |
|---|---|---|---|---|---|
| Unblocked Developer | Red | 0.15 | 3.68 | 99 | 75 |
| Compound 6 | Red | 0.13 | 0.15 | | |
| Compound 6 + $KF.2H_2O$ | Red | 0.16 | 2.81 | 68 | 61 |

Reasonable modifications and variations are possible from the foregoing disclosure without departing from either the spirit or scope of the present invention as defined by the claims.

What is claimed is:

1. A heat-developable, photothermographic element comprising a support bearing at least one photosensitive, image-forming photothermographic-emulsion layer consisting essentially of:

(a) a photosensitive silver halide;
(b) a non-photosensitive, reducible silver source;

(c) a reducing agent for said non-photosensitive, reducible silver source;

(d) a binder; and (c) a compound capable of releasing, in the presence of a source of fluoride ion, a material AH, which is either a stabilizer, toner, or activator and is not ar educing agent for said non-photosensitive, reducible silver source, said compound having the formula:

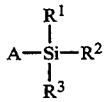

wherein:

$R^1$, $R^2$, and $R^3$ independently represent hydrogen, an alkyl group, an aryl group, and aralkyl group, an alkaryl group, and an alkenyl group; and A represents a group in which a hydrogen atom of AH, which is either a stabilizer, toner, or activator and is not a reducing agent for said non-photosensitive, reducible silver source, has been replaced by:

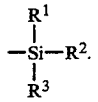

2. The photothermographic element according to claim 1 wherein said silver halide is silver bromide, silver chloride, or silver iodide or mixtures thereof.

3. The photothermographic element according to claim 1 wherein said non-photosensitive, reducible source of silver is a silver salt of a long chain carboxylic acid having from 10 to 30 carbon atoms.

4. The photothermographic element according to claim 1 wherein said reducing agent is a compound capable of being oxidized to form or release a dye.

5. The photothermographic element according to claim 4 wherein said compound capable of being oxidize, d is a leuco dye.

6. The photothermographic element according to claim 1 wherein said binder is hydrophilic.

7. The photothermographic element according to claim 1 wherein said binder is hydrophobic.

8. The photothermographic element according to claim 1 wherein $R^1$, $R^2$, and $R^3$ independently represent a $C_1$ to $C_{12}$ alkyl, aryl, aralkyl, alkaryl, or alkenyl group.

9. The photothermographic element according to claim 8 wherein $R^1$, $R^2$, and $R^3$ independently represent a $C_1$ to $C_6$ alkyl, aryl, aralkyl, alkaryl, or alkenyl group.

10. The photothermographic element according to claim 1 wherein said source of fluoride ion is potassium fluoride dihydrate, tetrabutylammonium fluoride, benzoyl fluoride, cyanuric fluoride, $BF_4^-$, $PF_6^-$, $SbF_6^-$, or $KSO_2F$.

11. The photothermographic element according to claim 1 wherein A is substituted by one or more substituents R, wherein R represents a group chosen from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonio, phosphono, and silyloxy groups having up to 18 carbon atoms and wherein any two or three R groups may together form a fused ring structure with any central benzene ring.

12. A heat-developable, photothermographic element comprising a support bearing at least one photosensitive, image-forming photothermographic emulsion layer comprising:

(a) a photosensitive silver halide;

(b) a non-photosensitive, reducible silver source;

(c) a binder; and (d) a compound capable of releasing, in the presence of a source of fluoride ion, a reducing agent for said non-photosensitive, reducible silver source, said compound having the formula:

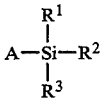

wherein:

$R^1$, $R^2$, and $R^3$ independently represent hydrogen, an alkyl group, an aryl group, an alkaryl group, an aralkyl group, and an alkenyl group; and A represents a group in which a hydrogen atom of the corresponding compound AH, which is a reducing agent for said non-photosensitive, reducible source of silver, has been replaced by:

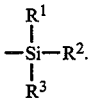

13. The photothermographic element according to claim 12 wherein said silver halide is silver bromide, silver chloride, or silver iodide or mixtures thereof.

14. The photothermographic element according to claim 12 wherein said non-photosensitive, reducible source of silver is a silver salt of a long chain carboxylic acid having from 10 to 30 carbon atoms.

15. The photothermographic element according to claim 12 wherein said binder is hydrophilic.

16. The photothermographic element according to claim 12 wherein said binder is hydrophobic.

17. The photothermographic element according to claim 12 wherein $R^1$, $R^2$, and $R^3$ independently represent a $C_1$ to $C_{12}$ alkyl group, aryl group, aralkyl group, alkaryl group, or alkenyl group.

18. The photothermographic element according to claim 17 wherein $R^1$, $R^2$, and $R^3$ independently represent a $C_1$ to $C_6$ alkyl, aryl, aralkyl, alkaryl, or alkenyl group.

19. The photothermographic element according to claim 12 wherein said source of fluoride ion is potassium fluoride dihydrate, tetrabutylammonium fluoride, benzoyl fluoride, cyanuric fluoride, $BF_4^-$, $PF_6^-$, $SbF_6^-$, or $KSO_2F$.

20. The photothermographic element according to claim 12 wherein A is substituted by one or more substituents R, wherein R represents a group chosen from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonio, phosphono, and silyloxy groups having up to 18 carbon atoms and wherein any two or three R groups may together form a fused ring structure with any central benzene ring.

* * * * *